US009539579B2

(12) United States Patent
Azzolin et al.

(10) Patent No.: US 9,539,579 B2
(45) Date of Patent: Jan. 10, 2017

(54) BUCKET FOR CRUSHING INERT MATERIAL

(71) Applicant: MECCANICA BREGANZESE S.p.A. in breve MB S.p.A., Fara Vicentino (IT)

(72) Inventors: Guido Azzolin, Breganze (IT); Diego Azzolin, Breganze (IT)

(73) Assignee: MECCANICA BREGANZESE S.p.A. IN BREVE MB S.p.A., Fara Vicentino (VI) (IT)

( * ) Notice: Subject to any disclaimer, the term of this patent is extended or adjusted under 35 U.S.C. 154(b) by 0 days.

(21) Appl. No.: 14/348,616

(22) PCT Filed: Sep. 28, 2012

(86) PCT No.: PCT/IB2012/055186

§ 371 (c)(1),
(2) Date: Mar. 31, 2014

(87) PCT Pub. No.: WO2013/046164

PCT Pub. Date: Apr. 4, 2013

(65) Prior Publication Data

US 2014/0231561 A1 Aug. 21, 2014

(30) Foreign Application Priority Data

Sep. 30, 2011 (IT) ..... PD2011A0308

(51) Int. Cl.
*B02C 1/02* (2006.01)
*B02C 23/02* (2006.01)
(Continued)

(52) U.S. Cl.
CPC ..... *B02C 23/02* (2013.01); *B02C 1/02* (2013.01); *B02C 23/08* (2013.01); *E02F 3/404* (2013.01); *E02F 3/965* (2013.01)

(58) Field of Classification Search
CPC ..... B02C 1/10; B02C 1/04; B02C 1/025; B02C 1/02; B02C 23/02; B02C 1/005; B02C 1/043; B02C 2/007; B02C 4/286; E02F 3/965; E02F 3/404
(Continued)

(56) References Cited

U.S. PATENT DOCUMENTS 1,897,156 A * 2/1933 Wells ..... D21D 5/06 209/270
3,532,276 A * 10/1970 Dunn ..... 241/77
(Continued)

FOREIGN PATENT DOCUMENTS

WO 2004020747 A1 3/2004

OTHER PUBLICATIONS

ISR and Written Opinion in PCT/IB2012/055186 dated Dec. 6, 2012.

*Primary Examiner* — Faye Francis
(74) *Attorney, Agent, or Firm* — Kristina Castellano; Castellano PLLC

(57) ABSTRACT

A bucket for crushing inert material comprising an outer casing and crushing means arranged in the casing for crushing the material, and additionally comprising a rotating tubular body, rotatable about an axis substantially parallel to a feed direction for the material and disposed upstream with respect to the crushing means in such a way that the material, before being sent to the crushing means, passes inside the rotating body in order to impart to it a rotational movement.

10 Claims, 5 Drawing Sheets

SECTION III

(51) Int. Cl.
*E02F 3/40* (2006.01)
*B02C 23/08* (2006.01)
*E02F 3/96* (2006.01)

(58) Field of Classification Search
USPC ..... 241/101.73, 264, 265, 266, 245, 246,241/248, 249, 81
See application file for complete search history.

(56) References Cited

U.S. PATENT DOCUMENTS

| | | | | |
|---|---|---|---|---|
| 5,054,958 | A * | 10/1991 | Strunk | E02F 5/30 241/101.73 |
| 5,181,663 | A * | 1/1993 | Dorscht | B02C 17/02 241/101.761 |
| 7,222,807 | B2 * | 5/2007 | Azzolin | 241/201 |
| 7,980,501 | B2 * | 7/2011 | Ueda | B02C 1/04 241/101.73 |
| 8,011,607 | B1 * | 9/2011 | Rossi, Jr. | B02C 1/02 241/101.2 |
| 8,322,643 | B2 * | 12/2012 | Gervais | B02C 1/04 241/101.742 |
| 8,727,252 | B1 * | 5/2014 | Phipps | E02F 3/404 241/101.73 |
| 2005/0194483 | A1 | 9/2005 | Sawant | |
| 2008/0000112 | A1 | 1/2008 | Schenk | |
| 2012/0018558 | A1 * | 1/2012 | Gervais | B02C 1/04 241/101.74 |
| 2014/0326816 | A1 * | 11/2014 | Azzolin | B07B 1/15 241/81 |

* cited by examiner 100
5
A
2
21
X
4
41
42
1

41
20

SEC. IV
41
2
4
41

III
1
6
62
4
IV
IV
2
21
X
III 60
61
62
2
23
23

BUCKET FOR CRUSHING INERT MATERIAL

CLAIM FOR PRIORITY

This application is a U.S. National Stage Application of PCT/IB2012/055186 filed on Sep. 28, 2012, which claims priority to Italian application number PD 2011A000308 filed Sep. 30, 2011, the contents of both of which are incorporated herein by reference.

The present invention relates to a bucket for crushing inert material of the type comprising the characteristics mentioned in the preamble of the main claim.

In the technical field being referred to, buckets are known, which can be applied to the end of the arm of an operating machine, and which comprise an outer casing, which machine is configured to collect inert material, such as rubble, material resulting from the demolition of buildings, inside which there are fitted means for crushing the collected material.

The crushing means can for example be produced by a pair of jaws which acts on the material to be crushed with an alternating movement, such as for example that described in European patent EP 1532321.

In such buckets, there is also defined an aperture for the material to be crushed, inside which the material is inserted by making the bucket perform a collecting scoop function, by means of the movement of the arm of the operating machine.

Once the material is collected, the bucket is raised so as to direct, substantially by gravity, the material to the crushing means from which, once crushed, it is left to drop in the form of rubble of sufficiently reduced dimensions.

In this context, since the crushing of the material does not occur during the material collection stage, except for minimal quantities, it is desirable to collect at every collection stage the greatest possible quantity of material.

To this end, it is known how to produce buckets in which the outer casings that support the crushing means have their inlet opening, for loading the material to be crushed, of a larger cross-section with respect to the outlet aperture for the discharge of the material processed, to crushing and to screening successively.

However, due to the narrowing in the cross-section of the casing of the bucket, which such solutions require, the material collected can easily remain jammed, especially if it is of large dimensions and with sharp edges, or even if when it is collected it is not oriented correctly with respect to the longitudinal development of the bucket.

Consequently, it is actually not possible to significantly broaden the inlet opening with respect to the section in which the crushing occurs since continuous blockages of the material would be taking place, hindering the increase in productivity obtainable from the larger loading capacity of bucket.

In addition, it must also be observed that the crushing members have a high weight, and consequently, it would be particularly desirable to produce an increase in working capacity of the bucket, which is understood to be the quantity of material that is possible to crush at every collection cycle, for the same dimensions of the crushing members.

However, the effect of the weight of the crushing members contained inside the casing influences the producers of buckets to restrict as far as possible the width of the opening of the crusher in order to keep its overall weight sufficiently low, so as to be able to be supported by common operating machines.

Therefore, the technical problem underlying the present invention is that of providing a bucket for crushing inert material which enables the abovementioned drawbacks with reference to the prior art to be addressed. This problem is solved by the bucket according to claim 1.

The present invention exhibits some significant advantages. The main advantage consists of the fact that the bucket according to the present invention can use an inlet aperture for the material to be crushed with a broadened cross-section limiting as far as possible the risk that the material jams before reaching the crushing means and, consequently, allows a notable increase in productivity, understood as the quantity of crushed material, with respect to buckets with similar characteristics produced according to the prior art.

Other advantages, features and the modes of use of the present invention will become clear from the following detailed description of some embodiments, presented by way of example and in a non-limiting manner. Reference will be made to the figures of the appended drawings, in which.

Figures 1, 2, 3A, 4, 4A:
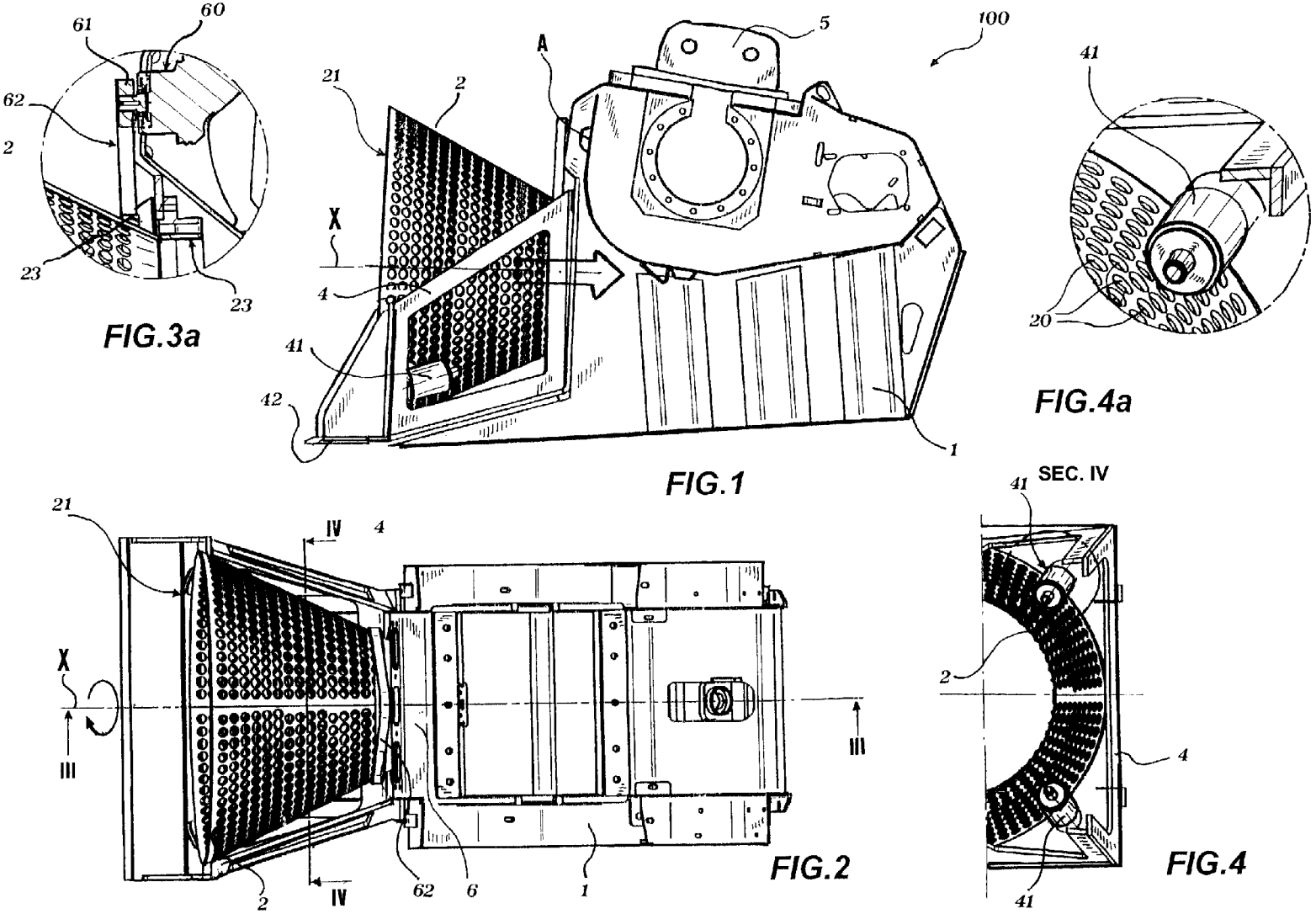
FIG. 1 is a side view of a bucket according to the present invention.
FIG. 2 is a view from above of the bucket of FIG. 1.
FIGS. 3 and 3A are a cross-sectional view from the side and an associated detail of the bucket of FIG. 1.
FIGS. 4 and 4A are a partial cross-sectional view from the front and an associated detail of the bucket of FIG. 1.

With reference initially to FIG. 1, a bucket for crushing inert material, such as for example scrap material coming from building demolitions or excavations, is indicated in an overall manner by the reference number 100. Such a bucket is of the type suitable for being fitted to a movable arm 101 of an operating machine 102, not illustrated in the drawings, by means of a connecting plate 5 or other equivalent attachment means. The bucket 100 comprises an outer casing 1, inside which there is arranged a crushing unit 3, illustrated schematically in FIG. 3.

The crushing unit 3 is disposed inside a feed channel 10 for the material to be crushed, along which a feed direction A is defined, substantially parallel to the direction of longitudinal development of the bucket.

Furthermore, according to a preferred embodiment, the crushing unit 3 is of the type with jaws, and comprises at least one movable jaw 31, preferably associated with a fixed jaw 32, which moves with alternating motion in a direction of crushing C substantially perpendicular to the direction of feed A of the material. On the other hand, the movement of the jaw 31 can be combined, with one component in the direction C and one component parallel to the feed direction A.

Is also noted that in the present embodiment, the channel 10 exhibits a cross-section of substantially rectangular shape, so as to permit the movement of the jaw 31 inside it.

Figure 3:
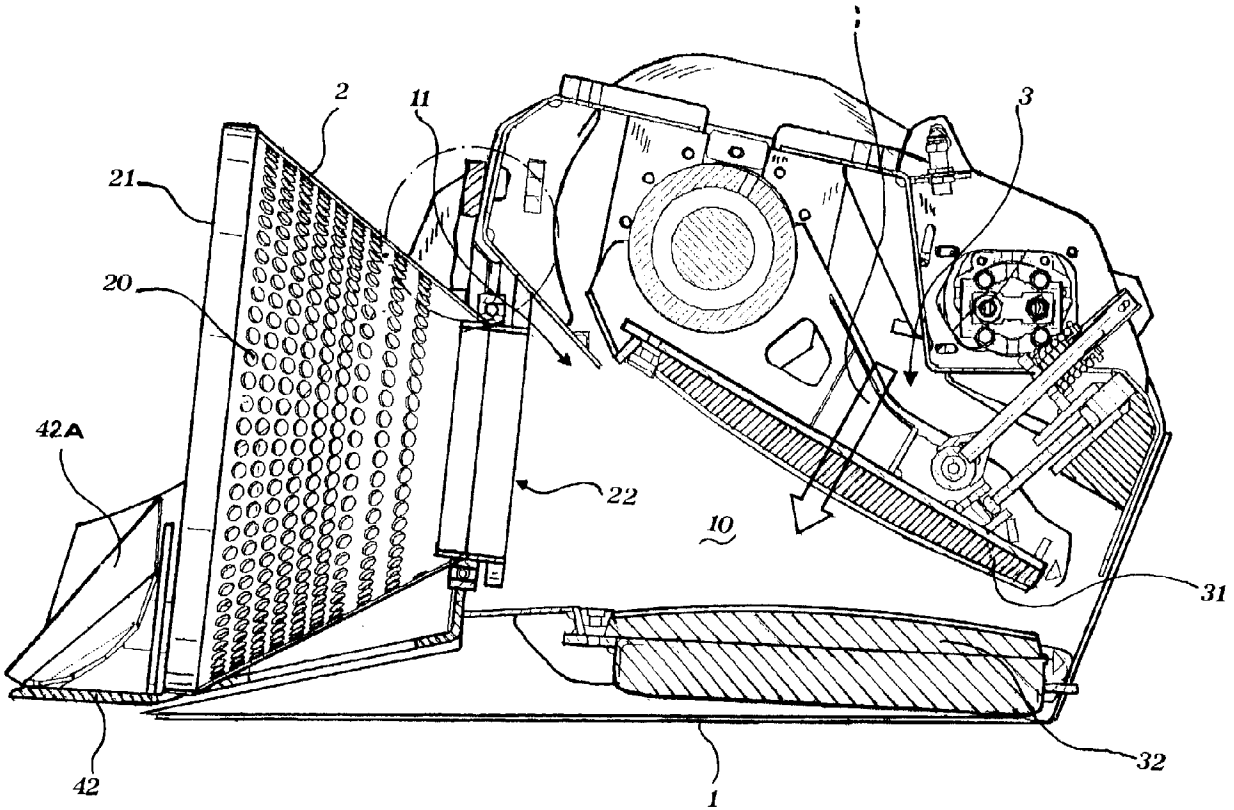

With reference to FIGS. 2 and 3, the bucket 100 also exhibits a rotating tubular body 2, of truncated cone shape, rotatably connected to the casing 1 in such a way that an outlet aperture 22 defined in the rotating body 2 is opposite an inlet aperture 11 of the casing 1 or, more generally, facing the channel 10.

In more detail, the rotating body 2 is rotatable about an axis X substantially parallel to the feed direction A for the material and is disposed upstream with respect to the crushing means 3 in such a way that the material, before being sent to the crushing means 3, can pass inside the rotating body 2.

Thus, the material to be crushed, before being sent to the crushing means 3, is placed in rotation and consequently screened. This rotation movement, therefore, allows the position of the material collected by the bucket 100 to be changed, notably reducing the risk that it remains jammed when advancing towards the crushing means.

Furthermore, the truncated cone shape, or more generally the use of a cross-section which narrows in the feed direction A for the material in the rotating body, provides for encouraging a positioning of the material according to an orientation that is more favourable to the successive crushing or to its entry into the area of the channel 10 in which the crushing unit is present. Specifically, during rotation in the truncated cone shaped body 2, the material will tend to be disposed in such a way that its direction of longitudinal development is parallel to the feed direction A.

The shape of the rotating body 2 also provides for advantageously using the inlet aperture 21 of the latter as inlet opening for the material to be crushed in the bucket 100.

In particular, the broadened section of the rotating body 2 will be able to collect a greater quantity of material compared to buckets produced according to the prior art, without however the risk that the material remains jammed before proceeding towards the crushing unit, hence making possible a considerable increase in the productivity of the machine.

In any case, it must be understood that the rotating body will be able to exhibit different shapes also, with for example a cylindrical shape or sphere portion, or otherwise it will still be able to, starting from the opening 21, initially be broadened and then be narrowed in accordance with that described previously.

With reference now to FIG. 3A, the rotating body 2 is supported by means of a fifth wheel coupling 23 or other equivalent bearing system on the casing 1, and is operated by a motor 60, which transmits the motion to the body 2 by means of a pulley 61 and belt 62 system.

The motor unit 6, formed by the motor 60 and by the motion transmission system defined by the belt and pulley, can be operated by the hydraulic circuit of the operating machine, not illustrated in the drawings. In this respect, it must be observed that the hydraulic circuit of the operating machine is normally used to also operate the crushing unit 3.

For the purposes of reducing the maximum capacity of the oil or other operating fluid required to operate the system, means can be provided for selectively sending the oil capacity to the motor unit 6 for the rotating body 2 or to a motor unit, not illustrated in the drawings, for the crushing unit. Indeed, it must be understood that the rotating body may rotate before the material is crushed and, therefore, when the material is collected and when the bucket is lifted.

Advantageously, a device can be provided for detecting the position of the bucket, in particular its inclination, and to selectively operate the rotating body 2 or the crushing unit based on the position of bucket.

As illustrated in the drawings, the rotating body 2 is further supported, at a distal end, opposite the end connecting with the casing 1, by a support structure 4 which extends cantilevered from the same casing 1.

Such a support structure 4 provides for rotatably supporting the rotating body 2 even at its distal end with respect to the casing 1, hence allowing the load on the fifth wheel coupling 23 to be reduced and, consequently, the capacity of the rotating body to be increased. It is noted, as represented FIG. 4A, that the support structure 4 comprises a pair of support rollers 41 on which the rotating body 2 is supported. In addition to the support rollers illustrated in the drawings, the use of a pin, also supporting a roller, can also be provided for, extending from the support structure 4 towards the inside of the rotating body, so as to obtain a further point of support.

Figure 5:
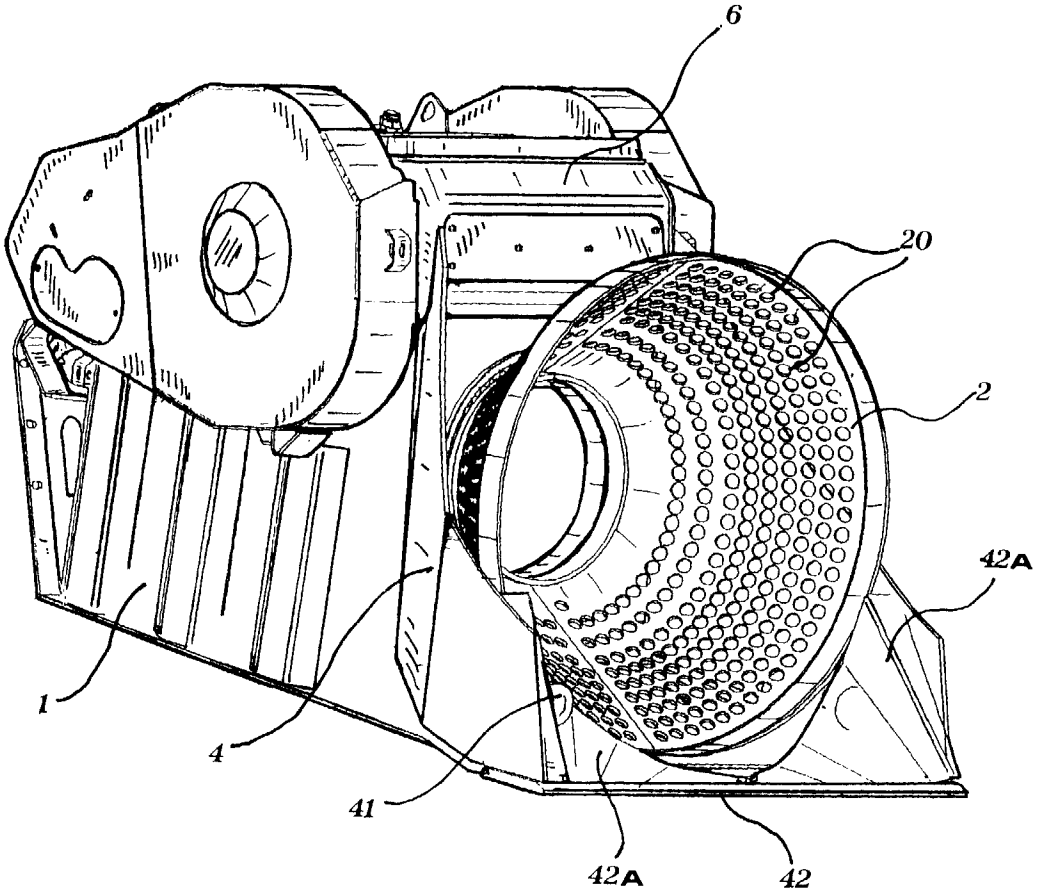
FIG. 5 is a perspective view of the bucket of FIG. 1.
Figure 6:
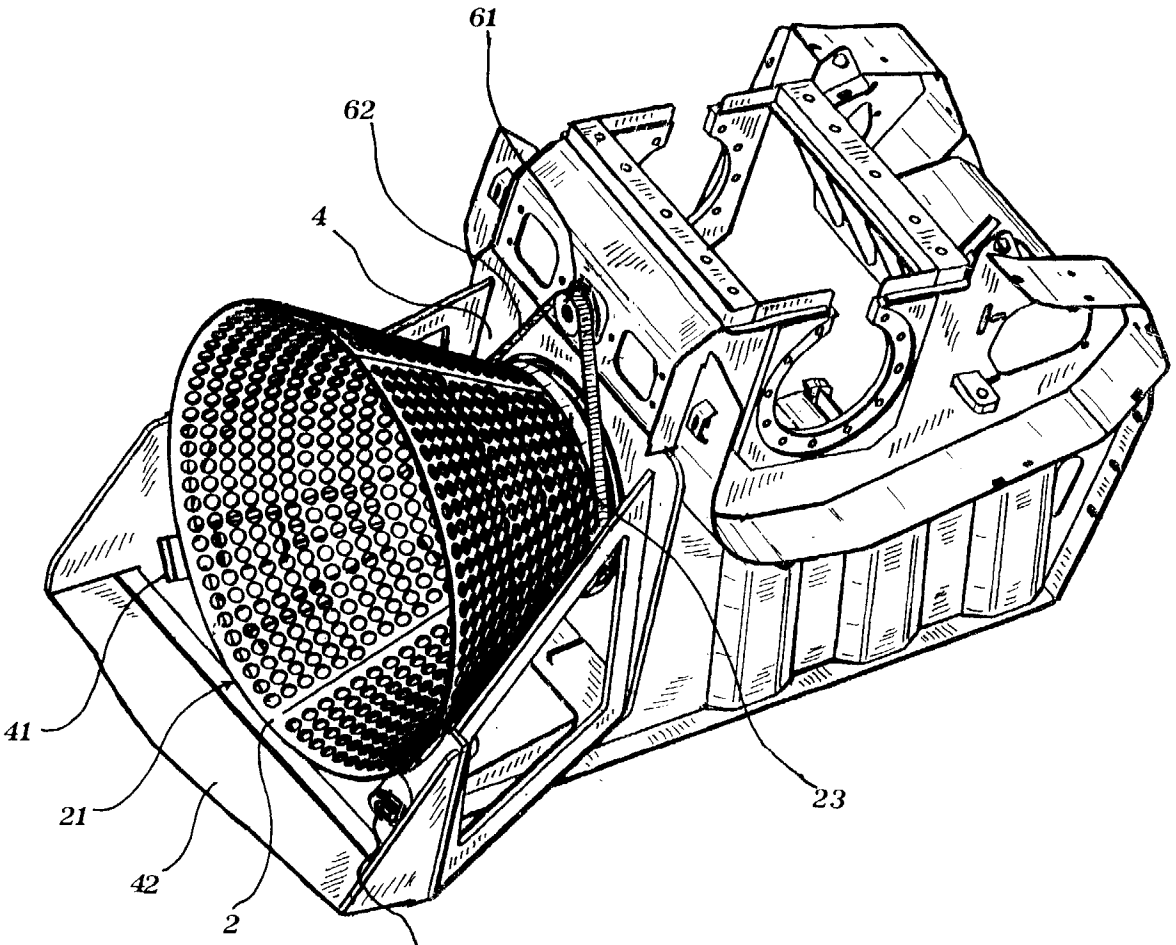
FIG. 6 is a further perspective view of the bucket according to the present invention, in which some outer parts have been removed for the purposes of illustrating its internal component-makeup.
Figure 7:
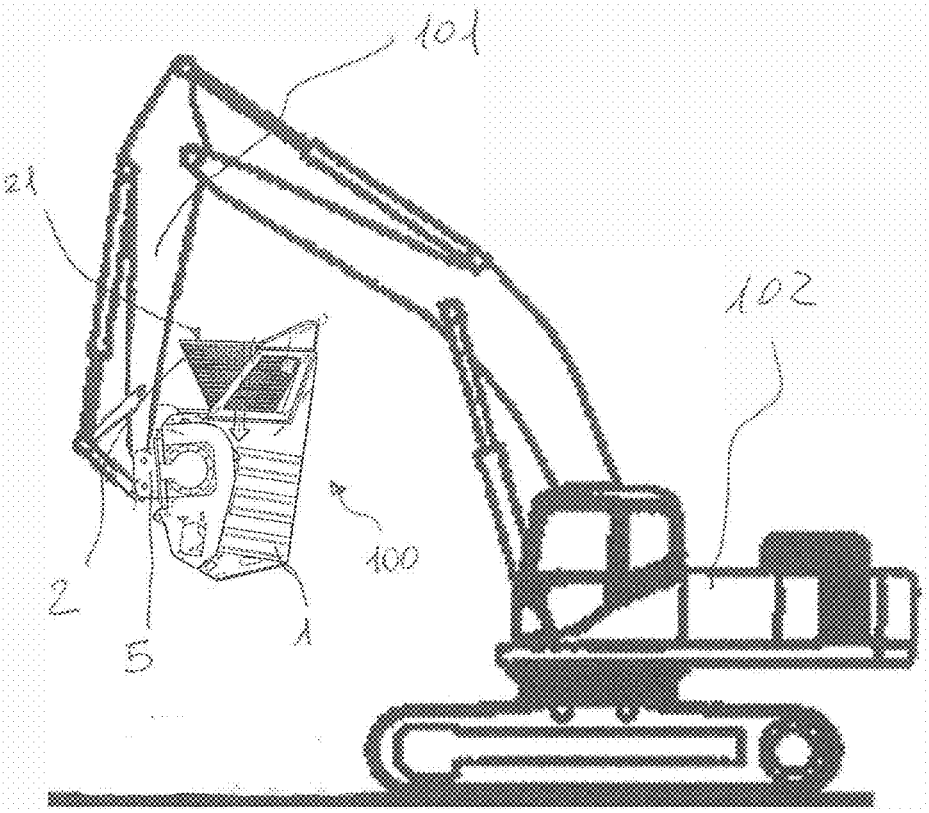
FIG. 7 depicts a non-limiting example of an operating machine and arm, having a bucket in accordance with non-limiting examples of the present invention, applied thereto.

With reference therefore to FIG. 5, the support structure 4 comprises a blade type appendage 42 disposed upstream of the tubular body 2 with respect to the feed direction A, providing an improvement in the collecting of the material to be crushed from the ground, or more generally, from a working surface.

Advantageously, the appendage 42 exhibits a sheet form and comprises a pair of slides 42A which extend from the base of the appendage 42 up to an area adjacent to the inlet opening 21 of the tubular body 2. In this area, the slides 42A follow the circular shape of the body 2 and thus create an invitation for the entry of material to be crushed.

A further advantage of the present invention is represented by the fact of using a rotating body 2 provided with a plurality of perforations 20 capable of releasing parts of collected material from the bucket that are of a size less than a predetermined dimension and retaining the parts having larger dimensions. Thus, as a result of the rotation of the rotating body, the parts of material having a size smaller than said predetermined dimension can be screened, hence providing for removing the parts of the collected material that do not need to be crushed. In other words, the rotating body 2 provided with perforations 20 implements a screening device which provides for limiting the quantity of fine debris, such as dust, sand and earth, that arrives at the crushing unit 3, the life of which is notably reduced due to the action of abrasion, caused by the fine debris, on the mechanical moving parts.

At the same time, the presence of the perforations, combined with the rotation of the material, provides for decompacting and expelling any build-ups of moist material which, if made to advance up to the crushing unit 3, risk being blocked on it, reducing its crushing effectiveness and forcing the operator to periodically stop the bucket for cleaning purposes from such build-ups.

It is also noted that the perforations 20 may have shapes and characteristics that are different from the circular shape depicted. In particular, they can be produced using retainers with grills, which hold the material of a size larger than a predetermined dimension while letting the remaining material drop.

Furthermore, according to a preferred embodiment, the rotating body 2 can be produced by a plurality of perforated panels removably connected to a support structure. This means that the screening effect can be easily adapted to different requirements, in particular to different materials to be crushed, by means of the simple substitution of the perforated panels.

The invention therefore solves the stated problem, attaining a plurality of advantages at the same time, including a notable increase in hourly productivity of the bucket over conventional crusher buckets. In particular, it is observed experimentally that the greater material collecting capacity, together with the advantages afforded by the screening, is more than double with respect to the prior art.

Furthermore, the basket shape of the rotating body, defined by the truncated cone shape or by the other previously described shapes, provides for creating a protection for the mechanical members operating the crushing unit and operating the rotating body itself hence also making the bucket particularly tough and durable with respect to the known solutions.

In addition, the possibility of increasing the load capacity of the bucket, the dimensions of the crushing unit being the same, turns out to be particularly advantageous, allowing a reduction in the overall weight of the bucket and, therefore, the possibility of using buckets with increased working capacities with respect to the known solutions, the characteristics of the operating machine to which it is attached being the same.

The invention claimed is:

1. A bucket for crushing inert material comprising a casing;

a crushing channel for the material to be crushed, the crushing channel being delimited inside the casing;

a crushing unit arranged in the casing and disposed inside the crushing channel, for crushing the inert material; and a rotating tubular body, rotatable about an axis (X) substantially parallel to a feed direction (A) for the material and disposed upstream with respect to the crushing unit in such a way that the material, before being sent to the crushing unit, passes inside the rotating tubular body;

wherein the feed direction (A) is defined along the crushing channel and the rotating tubular body is rotatably connected to the casing in such a way that an end portion of the rotating tubular body passes through an inlet aperture of the casing so that an outlet aperture of the rotating tubular body extends inside the crushing channel.

2. The bucket according to claim 1, wherein the rotating tubular body has a cross-section which narrows in the feed direction (A) of the material.

3. The bucket according to claim 2, wherein the rotating tubular body has a truncated cone or truncated pyramid shape open at opposing ends of the truncated cone or pyramid.

4. The bucket according to claim 1, wherein the rotating tubular body has a plurality of perforations suitable for permitting at least a partial screening of the material inside the rotating tubular body.

5. The bucket according to claim 1, wherein the rotating tubular body defines an inlet opening for the entry of the material to be crushed into the bucket.

6. The bucket according to claim 1, wherein said rotating tubular body is rotatably connected to the casing in such a way that an outlet aperture of the rotating tubular body is opposite an inlet aperture of the casing.

7. The bucket according to claim 1, comprising a support structure for the rotating body which extends cantilevered from the casing in such a way as to support the rotating tubular body rotatably in the region of a distal end thereof with respect to the casing.

8. The bucket according to claim 7, wherein said support structure comprises a blade which is attached to the support structure and disposed upstream of the rotating tubular body with respect to the feed direction (A) for the collection of the material from a working surface.

9. The bucket according to claim 1, comprising an attachment member which comprises a connecting plate for attachment of the bucket to a free end of an arm of an operating machine.

10. The bucket according to claim 1, wherein said crushing unit comprises at least one jaw movable in an alternating motion in a crushing direction (C) perpendicular to the feed direction (A) of the material.

* * * * *